United States Patent [19]

Lysenko

[11] 4,382,624

[45] May 10, 1983

[54] GRAPPLE PIVOT SNUBBER

[75] Inventor: George P. Lysenko, Dubuque, Iowa

[73] Assignee: Deere & Company, Moline, Ill.

[21] Appl. No.: 216,099

[22] Filed: Dec. 15, 1980

[51] Int. Cl.[3] ..... B66C 1/00

[52] U.S. Cl. ..... 294/88; 294/86 R; 294/67 R

[58] Field of Search ..... 294/88, 86 R, 106, 118, 294/70, 67 R; 414/739, 735, 725, 651; 37/183 R, 184, 185, 186, 183, 188

[56] References Cited

U.S. PATENT DOCUMENTS

| | | | |
|---|---|---|---|
| 3,301,587 | 1/1967 | Heikkinen | 294/67 |
| 3,933,389 | 1/1976 | Korber | 294/88 |
| 4,181,343 | 1/1980 | Lindqvist | 294/88 |
| 4,239,273 | 12/1980 | Dodemont et al. | 294/88 |

OTHER PUBLICATIONS

Advertising Brochure referring to ESCO Model 26 Grapple, published by ESCO Corporation and received by Deere & Company Patent Department on June 9, 1975, ESCO Catalog Supplement 1 (2 unnumbered, undated pages) bearing ahand-written date of May 1978.

*Primary Examiner*—James B. Marbert

[57] ABSTRACT

A grapple assembly includes a grapple suspended from an outer end of the grapple boom by means including a double clevis permitting the grapple to swing about a pair of crosswise disposed pivot axes. A double clevis is pivotally connected to the lower end of an upright output shaft which is rotatably mounted in the grapple boom. A fluid supply passage is provided in the shaft and has a first pair of outlets disposed diametrically from each other and in a vertical plane containing one of the pivot axes and a first pair of snubber hoses are connected between these outlets and the grapple frame. Similarly, a second pair of outlets of the passage are located diametrically from each other and in a vertical plane containing the other pivot axis and a second pair of snubber hoses are connected between these outlets and the frame. A hydraulic circuit is provided for selectively pressurizing the snubber hoses to thereby stiffen them and inhibit swinging movement of the frame about the pair of axes. In a second embodiment of the invention, the fluid supply passage in the output shaft has only a single outlet and it is located on the axis of the shaft and connected between this outlet and a blind bore on the frame is a single snubber hose which intersects the pivot axes of the frame.

4 Claims, 4 Drawing Figures

GRAPPLE PIVOT SNUBBER

BACKGROUND OF THE INVENTION

The present invention relates to grapple support structures and more particularly relates to snubbers incorporated in such support structures for inhibiting excessive grapple swing.

Grapples are commonly suspended from a grapple boom through a mounting structure embodying a swivel link through which first and second horizontal swing axes are established for the grapple arms to swing about, the axes being oriented crosswise to each other. In order to inhibit the free swinging of the grapple assembly about the horizontal pivot axes, it is known to incorporate spring-loaded friction devices in the pivot axes. These friction devices are not entirely satisfactory since the elements thereof require adjustment or replacement as they wear during use.

SUMMARY OF THE INVENTION

According to the present invention, there is provided an improved snubber for inhibiting excessive grapple swing.

An object of the invention is to provide a grapple snubber which includes no friction elements to adjust or wear out.

Another object of the invention is to provide a grapple snubber which may be adjusted from the operator's station so as to vary the amount of pivot stiffness.

A more specific object of the invention is to provide a snubber including one or more pressurizable hoses arranged crosswise to the pivot axes and pressurizable to varying extents to exhibit varying degrees of stiffness so as to exhibit varying degrees of resistance to pivoting of the grapple about the axes.

These and other objects of the invention will become apparent from reading the ensuing description, together with the appended drawings.

DESCRIPTION OF THE PREFERRED EMBODIMENT

Figure 1:
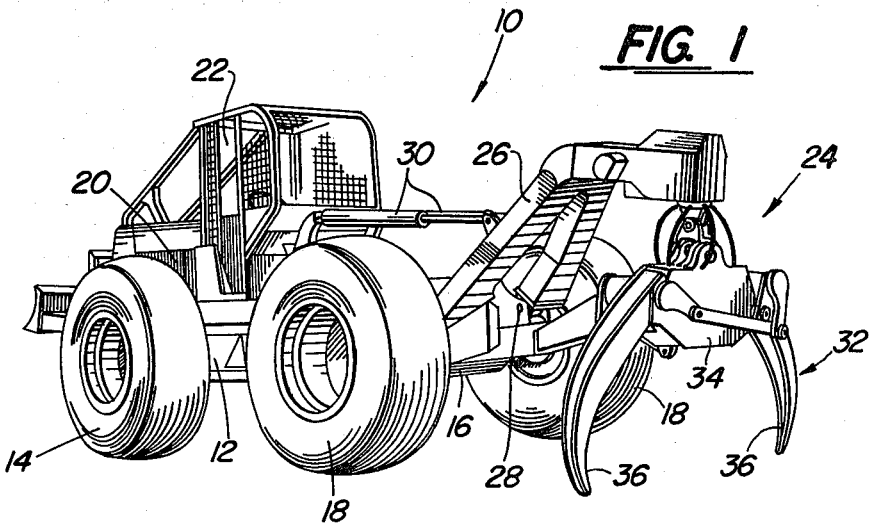
FIG. 1 is a left, rear perspective view of a grapple skidder incorporating a grapple suspended by a structure embodying a snubber constructed according to the principles of the present invention.
Figure 2:
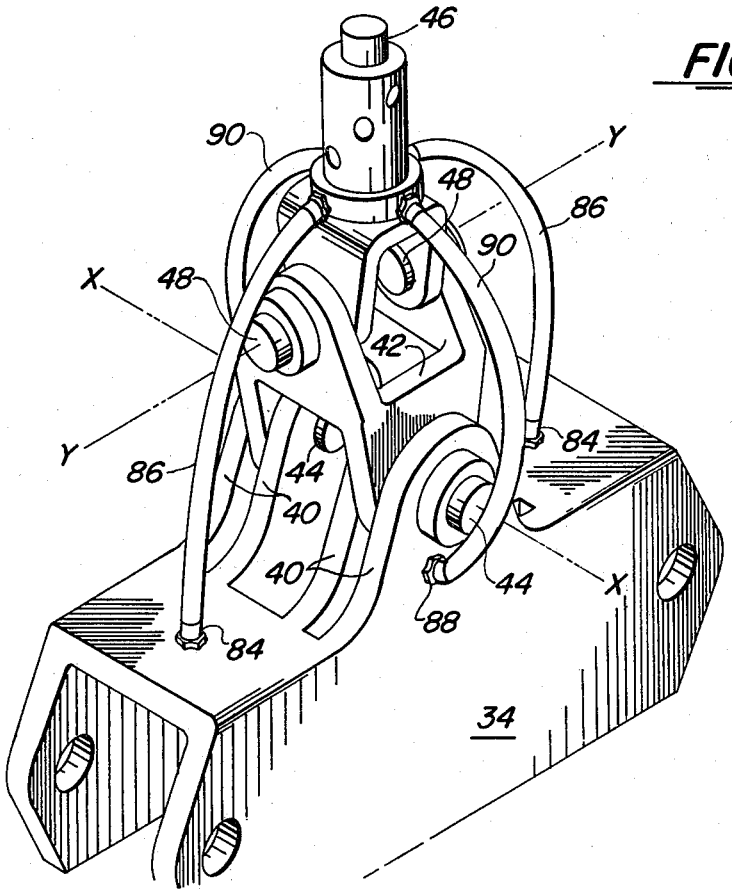
FIG. 2 is a perspective view showing the grapple head and the suspension structure for suspending it from the grapple boom shown in FIG. 1.

Referring now to FIG. 1, therein is shown a grapple skidder, indicated in its entirety by the reference numeral 10. The skidder is of a conventional type, including a front frame section 12 supported on a pair of front drive wheels 14 and a rear frame section 16 supported on a rear pair of drive wheeels 18, the sections 12 and 16 being interconnected by a vertical pivot assembly (not shown). A prime mover (not shown) is mounted on a forward portion of the front frame section 12 and is enclosed by an engine compartment 20. An operator's station 22 is mounted on a rear portion of the frame section 12 behind the engine compartment 20 and has various controls for various functions of the skidder located thereat.

A grapple assembly 24 is carried by the rear frame section 16 and includes an inverted V-shaped support boom 26. The support boom 26 is mounted for vertical swinging movement about a horizontal transverse axis defined by a pair of pivot connections 28 (only one shown) respectively connecting the inner ends of the legs of the boom to the frame section 16. Connected between the rear frame section 16 and the legs of the support boom 26 are a pair of hydraulic actuators 30, only one of which is shown. Suspended from the outer end of the support boom 26 is a grapple 32 including a grapple frame 34 to which a pair of grapple arms 36 are pivotally mounted for swinging between open and closed positions, the opening and closing of the arms 36 being accomplished by an extensible and retractable hydraulic actuator 38 (FIG. 3) having its opposite ends connected to the pair of arms 36. The frame 34 is provided with two sets of upstanding ears or lugs 40 which are respectively pivotally connected to a depending pair of lugs or ears of a double clevis 42 by means of a first set of axially aligned pivot pins 44 defining a horizontal pivot axis X. The swivel joint 42 includes a pair of upstanding lugs which are pivotally connected to a depending pair of lugs of a reversible hydraulic motor output shaft 46 by means of a second pair of axially aligned pivot pins 48 defining a horizontal pivot axis Y which extends at a right angle to the axis X.

Figure 3:
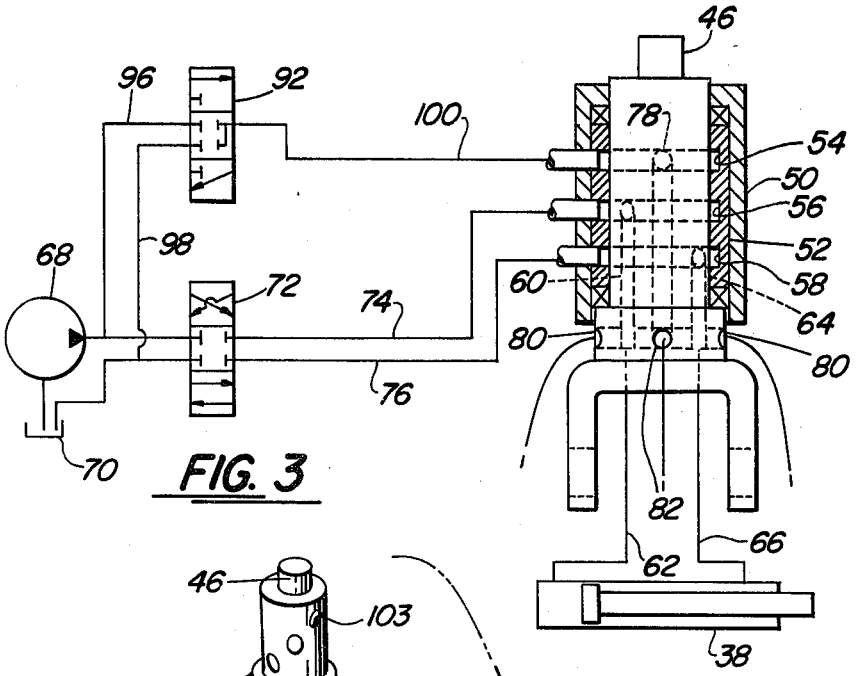
FIG. 3 is a schematic representation of the hydraulic circuitry used for connecting the source of fluid pressure to the grapple control cylinder and the snubber hoses.

As can best be seen in FIG. 3, the shaft 46 is journalled for rotation in a housing 50 forming an outer end of the support boom 26. Located in the housing 50 and surrounding the shaft 46 is a manifold ring 52 having upper, intermediate and lower grooves 54, 56 and 58 respectively, formed therein. The intermediate groove 56 is in fluid communication with one end of a passage 60 formed internally in the shaft 46 and having a lower end extending to an outer surface of the shaft and connected to one end of the actuator 38 by means of a hydraulic hose 62. Similarly, the lower groove 58 is in fluid communication with an upper end of a passage 64 having a lower end exiting at the surface of the shaft 46 and connected to another end of the actuator 38 by means of a hydraulic hose 66. A pump 68 and reservoir 70 are connected to a directional control valve 72 which, in turn, is connected to the intermediate and lower grooves 56 and 58 of the manifold ring 52 by means of supply-return conduits 74 and 76.

The upper groove 54 of the manifold ring 52 is connected in fluid communication with an upper end of a branched passage 78 extending internally within the shaft 46 and having a first pair of diametrically opposite outlets 80 disposed in a vertical plane which extends through the axis Y and includes a second pair of diametrically opposite outlets 82 which are located in a vertical plane extending through the axis X. Connected between the outlet 80 and a first pair of dead end connections 84, which are co-planar with the outlets 80, are a first pair of hydraulic snubber hoses 86. Similarly, connected between the second pair of outlets 82 and a second pair of dead end connections 88 secured to the frame 34 in locations which are co-planar with the connections 82 are a second pair of hydraulic snubber hoses 90. The hydraulic snubber hoses 86 and 90 are selectively pressurized to thereby stiffen them or inhibit swinging movement of the grapple frame 34 about the axes X and Y through means of a directional control valve 92 connected to the pump and reservoir 68 and 70 by means of fluid conduits 96 and 98 respectively and to the manifold ring groove 54 by means of a pressure-return conduit 100.

Figure 4:
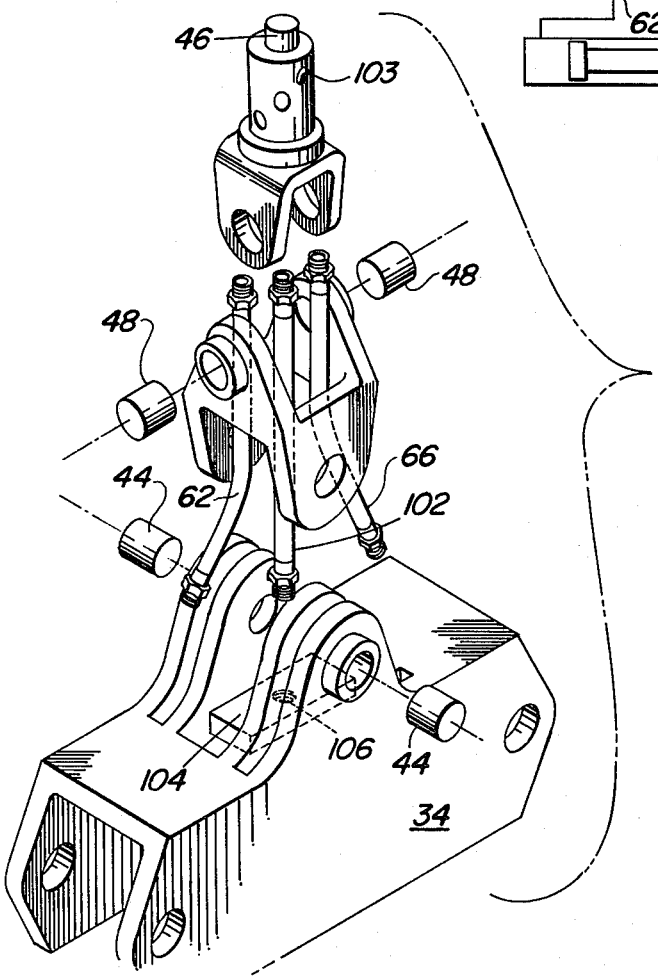
FIG. 4 is an exploded view of the components shown in FIG. 2 but showing a modified form of snubber utilizing only one hose.

Referring now to FIG. 4, therein is shown a modified form of the invention wherein only a single snubber hose 102 is employed and is connected between the lower end 103 of a passage (not shown) which exits on the axis of the output shaft 46 and has its upper end adapted to register with the upper groove 54. The lower end of the snubber hose 102 is connected to a cross-plate 104, added to the grapple frame 34, by a dead end connection defined by a blind bore 106 in the cross-plate 104 and a threaded fitting at the lower end of the hose 102. Thus, the snubber hose 102 extends along the axis of the shaft 46 and accordingly, intersects both of the axes X and Y. It will be appreciated, then, that when the hose 102 is pressurized, it stiffens and inhibits pivoting of the grapple frame 34 about the axes X and Y.

The operation of the invention is thought to be clear from the foregoing description and for the sake of brevity, no further description is given.

I claim:

1. In a grapple arm support structure including a boom, an upright shaft rotatably supported from the boom, a grapple arm support frame, and a double clevis connected between the shaft and the frame and establishing first and second horizontal pivot axes extending crosswise to each other for the support frame to swing about, a snubber assembly for resisting the swinging movement of the grapple frame about the horizontal axes comprising: said upright shaft being provided with passage means; hydraulic hose means having first end means connected to said passage means and having second end means dead-end connected to the grapple frame such that the hose means is located in substantially intersecting relationship to the first and second horizontal pivot axes; and hydraulic fluid supply means connected to the passage means for selectively pressurizing and thus stiffening the hose means whereby the pressurized hose means resists pivoting of the grapple frame about said axes.

2. The combination defined in claim 1 wherein the hose means comprises a single hose located along an upright pivot axis defined by the upright shaft and wherein the double clevis includes a central opening receiving the single hose.

3. The combination defined in claim 1 wherein the hose means comprises first and second pairs of hoses with the first pair of hoses being respectively arranged at opposite sides of the clevis in substantial intersecting relationship to the first horizontal axis and with the second pair of hoses being respectively arranged at opposite sides of the clevis in substantial intersecting relationship to the second horizontal axis.

4. In a grapple arm support structure including a boom and a double clevis connected between the boom and the frame and establishing first and second horizontal pivot axes extending crosswise to each other for the support frame to swing about, a snubber assembly for resisting the swinging movement of the grapple frame about the horizontal axes, comprising: hydraulic hose means having first end means connected to the boom and second end means dead-end connected to the grapple frame with the hose means being in substantially intersecting relationship to the first and second horizontal pivot axes; and hydraulic fluid supply means connected to the first end means of the hose means for selectively pressurizing and thus stiffening the latter whereby the pressurized hose means resists pivoting of the grapple frame about said axes.

* * * * *